US009802074B2

(12) United States Patent
Tschann

(10) Patent No.: US 9,802,074 B2
(45) Date of Patent: Oct. 31, 2017

(54) OUTDOOR FITNESS RESISTANCE MECHANISM AND HOUSING

(71) Applicant: Landscape Structures Inc., Delano, MN (US)

(72) Inventor: Matthew A. Tschann, Burnsville, MN (US)

(73) Assignee: Landscape Structures Inc., Delano, MN (US)

( * ) Notice: Subject to any disclaimer, the term of this patent is extended or adjusted under 35 U.S.C. 154(b) by 119 days.

(21) Appl. No.: 14/799,167

(22) Filed: Jul. 14, 2015

(65) Prior Publication Data

US 2016/0016031 A1 Jan. 21, 2016

Related U.S. Application Data

(60) Provisional application No. 62/026,467, filed on Jul. 18, 2014.

(51) Int. Cl.
*A63B 21/015* (2006.01)
*A63B 22/06* (2006.01)
(Continued)

(52) U.S. Cl.
CPC ..... *A63B 21/225* (2013.01); *A63B 21/00069* (2013.01); *A63B 21/015* (2013.01);
(Continued)

(58) Field of Classification Search
CPC ..... A63B 21/00058; A63B 21/00069; A63B 21/00072; A63B 21/00076; A63B 21/012;
(Continued)

(56) References Cited

U.S. PATENT DOCUMENTS 1,610,504 A * 12/1926 Fitts ..... F16F 15/3153 74/572.2
3,831,942 A 8/1974 Del Mar
(Continued)

FOREIGN PATENT DOCUMENTS

CN 201469981 U 5/2010
CN 201643537 U 11/2010
(Continued)

OTHER PUBLICATIONS

International Search Report and Written Opinion for International Application No. PCT/US2015/040558, dated Oct. 16, 2015, date of filing: Jul. 15, 2015, 14 pages.
(Continued)

*Primary Examiner* — Joshua Lee
(74) *Attorney, Agent, or Firm* — Kelly, Holt & Christenson, PLLC; Katherine M. Scholz

(57) ABSTRACT

A resistance mechanism for an exercising device is provided. In one embodiment, the resistance mechanism comprises at least one flywheel. The resistance mechanism may also comprise at least one resistance index wedge configured to engage with the at least one flywheel. The resistance mechanism may also comprise a resistance adjustment mechanism connected to the resistance index wedge and configured to alter a resistance provided to the exercise device by increasing pressure provided by the at least one resistance index wedge to the at least one fly wheel assembly, wherein the resistance mechanism is configured to operate in an outdoor environment.

18 Claims, 8 Drawing Sheets

(51) Int. Cl.

| | |
|---|---|
| ***A63B 21/012*** | (2006.01) |
| ***A63B 21/22*** | (2006.01) |
| ***A63B 21/00*** | (2006.01) |
| ***A63B 71/02*** | (2006.01) |
| ***A63B 22/00*** | (2006.01) |
| *A63B 22/04* | (2006.01) |
| *A63B 23/12* | (2006.01) |

(52) U.S. Cl.
CPC ..... *A63B 22/0002* (2013.01); *A63B 71/02* (2013.01); *A63B 21/4029* (2015.10); *A63B 22/0056* (2013.01); *A63B 22/04* (2013.01); *A63B 22/0664* (2013.01); *A63B 23/1209* (2013.01); *A63B 2209/02* (2013.01)

(58) Field of Classification Search
CPC ... A63B 21/0125; A63B 21/015; A63B 21/22; A63B 21/222; A63B 21/225; A63B 21/227; A63B 22/06; A63B 2209/02; B62L 5/16; B62L 1/08; F16D 2125/66
See application file for complete search history.

(56) References Cited

U.S. PATENT DOCUMENTS 3,929,209 A * 12/1975 Peckham, Jr. ..... B62L 3/00 188/140 R
4,007,927 A * 2/1977 Proctor ..... A63B 21/015 482/63
4,047,715 A 9/1977 Gjessing
4,344,615 A * 8/1982 Carlson ..... A63B 23/14 188/251 A
4,357,010 A 11/1982 Telle
4,391,352 A * 7/1983 Brown ..... B62L 1/12 188/24.12
4,463,945 A 8/1984 Spector
4,620,703 A 11/1986 Greenhut
4,720,099 A 1/1988 Carlson
4,728,099 A 3/1988 Pitre
4,765,313 A 8/1988 Kumakura
4,772,013 A 9/1988 Tarlow, Jr.
4,789,153 A 12/1988 Brown
4,997,181 A 3/1991 Lo
5,051,638 A 9/1991 Pyles
5,062,633 A * 11/1991 Engel ..... A63B 21/015 482/118
5,064,034 A * 11/1991 Rupprecht ..... F16D 65/22 188/343
5,072,929 A 12/1991 Peterson et al.
5,224,727 A * 7/1993 Ramskugler ..... B62D 53/0871 280/432
5,256,124 A * 10/1993 Hughes ..... A63B 21/157 482/118
5,342,261 A 8/1994 Johnston
5,514,053 A 5/1996 Hawkins et al.
5,547,422 A 8/1996 Seboldt
5,626,209 A * 5/1997 Viola ..... B62L 1/16 188/24.14
6,099,440 A * 8/2000 Schurter ..... A63B 21/012 482/63
6,468,186 B2 10/2002 Lay
6,612,971 B1 9/2003 Morris
6,648,802 B2 11/2003 Ware
6,669,603 B1 * 12/2003 Forcillo ..... A63B 21/015 482/51
7,011,607 B2 3/2006 Kolda et al.
7,419,458 B2 9/2008 Forcillo
7,497,812 B2 3/2009 Neff et al.
7,530,932 B2 5/2009 Lofgren et al.
7,662,071 B2 2/2010 Ditolla
7,682,292 B1 3/2010 Lo
7,699,758 B1 4/2010 Hoggan et al.
7,901,334 B2 * 3/2011 Chen ..... A63B 21/00069 482/63
8,052,581 B1 * 11/2011 Lohr ..... A63B 21/015 482/63
8,585,561 B2 * 11/2013 Watt ..... A63B 21/0051 482/57
2001/0003110 A1 * 6/2001 Lay ..... A63B 21/0051 482/57
2001/0022029 A1 * 9/2001 Vary ..... B23D 17/02 30/228
2005/0096192 A1 * 5/2005 Chen ..... A63B 21/012 482/63
2008/0087505 A1 * 4/2008 Kobelt ..... F16D 55/2245 188/72.7
2009/0084639 A1 * 4/2009 Colegrove ..... B62L 1/005 188/26
2010/0029159 A1 * 2/2010 Ishihara ..... C08G 69/32 442/301
2010/0062909 A1 * 3/2010 Hamilton ..... A63B 24/0087 482/61
2010/0298104 A1 * 11/2010 Turner ..... A63B 21/00069 482/93
2011/0017168 A1 1/2011 Gilpatrick
2014/0262631 A1 * 9/2014 Cobb ..... B62L 1/16 188/24.21

FOREIGN PATENT DOCUMENTS

CN 101623546 B 11/2011
CN 202029947 U 11/2011
DE 2153054 A1 5/1973
DE 29906757 U1 * 7/1999 ..... B62L 1/12

OTHER PUBLICATIONS

International Preliminary Report on Patentability for PCT/US2015/040558 dated Feb. 2, 2017, 11 pages.

* cited by examiner

OUTDOOR FITNESS RESISTANCE MECHANISM AND HOUSING

CROSS-REFERENCE TO RELATED APPLICATION

The present application is based on and claims benefit of U.S. Provisional Patent Application Ser. No. 62/026,467, which was filed on Jul. 18, 2014, the contents of which is hereby incorporated by reference in its entirety.

BACKGROUND

Providing an outdoor fitness exercise machine presents many logistical challenges. The outdoor environment presents temperature at both the hot and cold extremes. Further, exercise equipment outdoors is also exposed to the elements—wind, rain and particulates. Additionally, providing consistent lubrication to the exercise equipment is a problem. For this reason, exercise equipment cannot merely be transferred from an indoor environment to an outdoor environment.

One particular challenge presenting outdoor fitness equipment is the ability to provide a resistance mechanism that is easy to operate by a user, presents a wide range of resistance options for exercise, and can hold up to the difficulties of the outdoor environment. A solution to these problems is desired.

SUMMARY

A resistance mechanism for an exercising device is provided. In one embodiment, the resistance mechanism comprises at least one flywheel. The resistance mechanism may also comprise at least one resistance index wedge configured to engage the at least one flywheel. The resistance mechanism may also comprise a resistance adjustment mechanism connected to the resistance index wedge and configured to alter a resistance provided to the exercise device by increasing pressure provided by the at least one resistance index wedge to the at least one fly wheel assembly, wherein the resistance mechanism is configured to operate in an outdoor environment. These and various other features and advantages that characterize the claimed embodiments will become apparent upon reading the following detailed description and upon reviewing the associated drawings.

DETAILED DESCRIPTION OF THE DRAWINGS

In one embodiment of the present invention, a universal resistance mechanism with a housing is provided. In one embodiment, the housing is a universal housing that is configured to operate in a plurality of exercise equipment options, for example, the exercise devices present in FIGS. 1A-F. While FIGS. 1A-F illustrate an elliptical, a chest press, a shoulder press, and a stair stepper it is to be understood that the resistance mechanism could be implemented in a plurality of other exercise devices, for example.

Figure 1A:
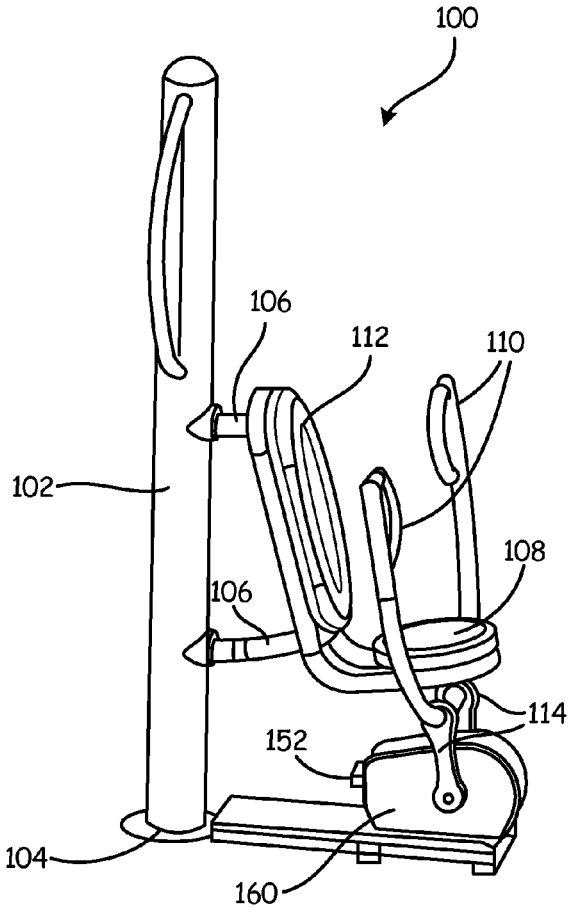
FIGS. 1A-1F depict a plurality of exercise devices that may be useful in embodiments of the present invention.
Figure 1B:
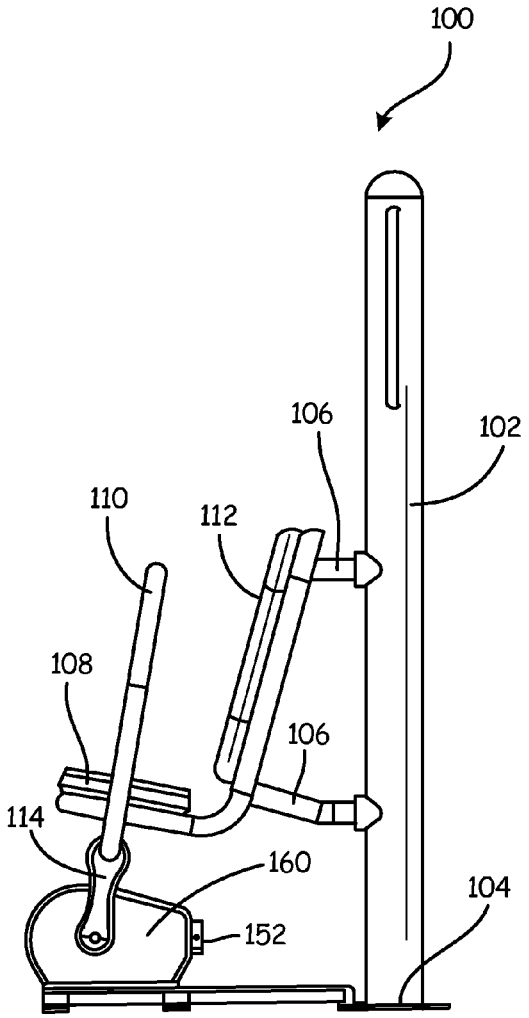

FIGS. 1A-F depict a plurality of exercise devices that may be useful in embodiments of the present invention. FIGS. 1A and 1B illustrate a chest press 100 that incorporates a resistance mechanism (not shown) located within housing 160. In one embodiment, chest press machine 100 illustratively comprises a post 102 that is connected to the ground at a fixed point 104. The advantage of having a post 102 connected to a fixed point 104 on the ground is that it may prevent, for example, theft of exercise equipment from an outdoor location such as a park. It also allows, for example, multiple exercise equipment options to be arranged about the post 102, allowing for a social exercise experience. In another embodiment, chest press machine 100 may be free moving. In a further embodiment, chest press machine 100 may only be fixed to the ground at fixed point 104.

In one embodiment, the chest press machine 100 comprises connections 106 that connect the post 102 to a seat 108 and/or a seatback 112 of the chest press machine. In one embodiment, the chest press machine 100 also includes one or more chest press arms 110. In one embodiment, the chest press arms provide adjustable levels of resistance, provided by the resistance mechanism located within the housing 160. In one embodiment, the resistance level provided by the resistance mechanism is translated to the chest press arms 110 through translation mechanism 114.

An adjustable resistance level offered to a user of the chest press machine 100 may, in one embodiment, be provided through a resistance mechanism 150. The resistance mechanism 150 may be located within a housing 160 that may or may not correspond directly to a size of the resistance mechanism 150. In one embodiment, the resistance mechanism 150 also includes a resistance adjustment mechanism 152. The resistance adjustment mechanism 152 allows a user of the chest press machine 100 to adjust a difficulty of the chest press machine. For example, a stronger person may desire greater resistance on the chest press arms 110 than a beginner. In one embodiment, the resistance adjustment mechanism 152 incorporates one or more button elements that allow a user to increase or decrease a resistance level. In another embodiment, the resistance adjustment mechanism 152 incorporates a knob that turns, allowing a user to increase or decrease resistance by rotating the knob. In another embodiment, the resistance adjustment mechanism 152 incorporates an alternative adjustment option.

Figure 1D:
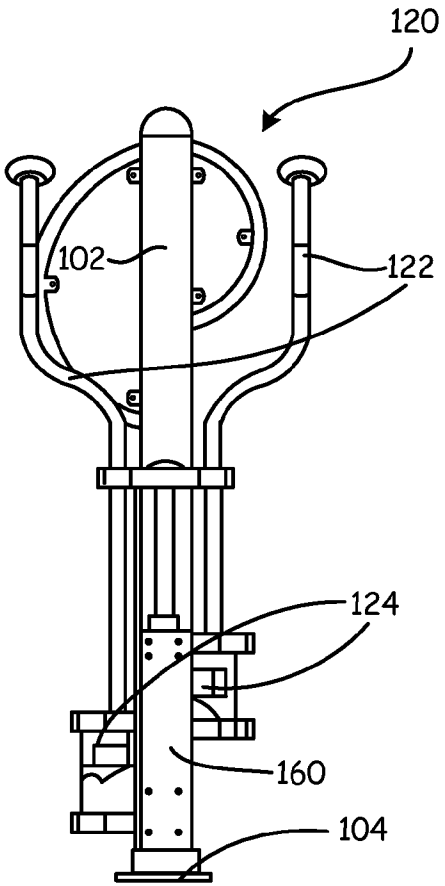
Figure 1C:
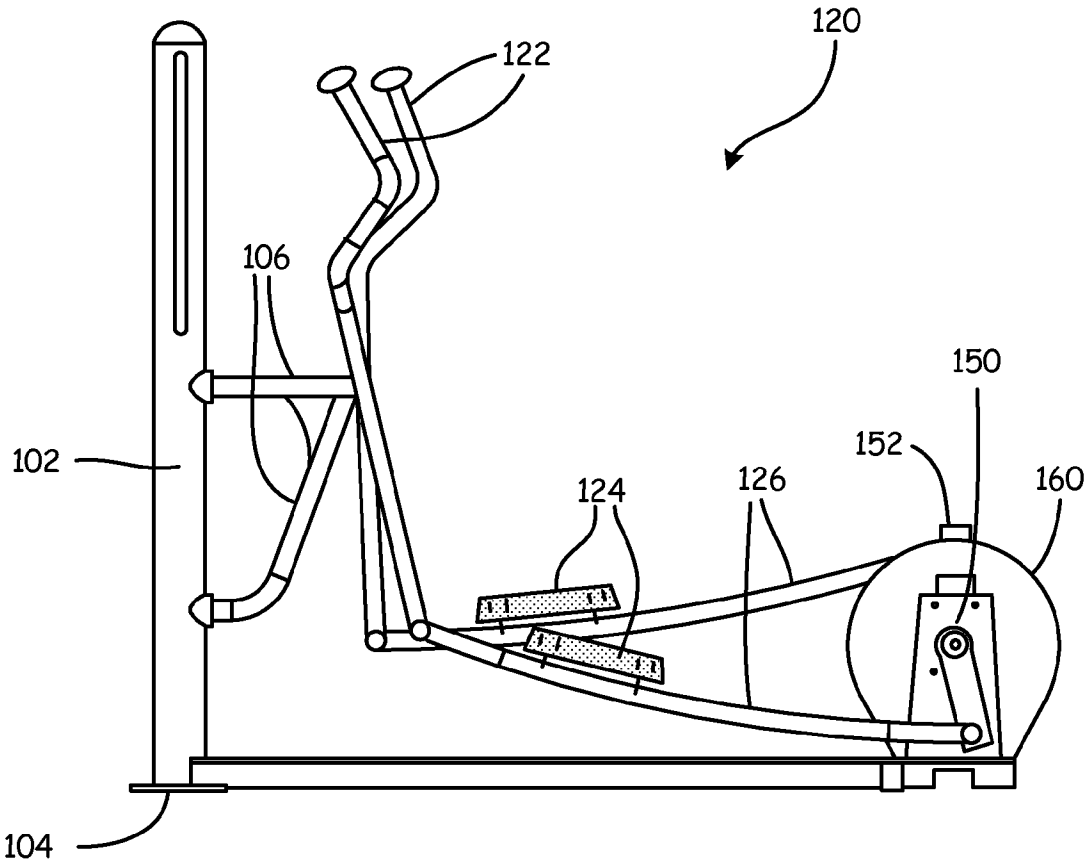

FIGS. 1C and 1D illustrate an elliptical machine 120 that also incorporates a resistance mechanism 150, located within housing 160. FIG. 1C illustrates a housing 160 with a window allowing a view of the resistance mechanism 150. However, in another embodiment, housing 160 may not allow for a view of the resistance mechanism 150. FIG. 1C illustrates a housing 160 significantly larger than the resistance mechanism 150. However, in another embodiment, housing 160 may be substantially the same size as the resistance mechanism 150. In another embodiment, the resistance mechanism 150 may be incorporated into the elliptical machine 120, or other exercise machine, without a separate housing 160. The resistance mechanism 150 translates resistance to the elliptical machine 120, in one embodiment, through one or more elliptical pedal levers 126 connected to the resistance mechanism 150. In this way, when a user of the elliptical machine 120 adjusts a resistance adjustment mechanism 152, their experience on the elliptical machine 120 changes. The elliptical machine 120 may comprise, in one embodiment, one or more elliptical arms 122 with or without handles. The elliptical machine 120 may also comprise one or more elliptical pedals 124 that are located on or near the elliptical pedal levers 126, and provide an engagement portion for the feet of a user.

Figure 1E:
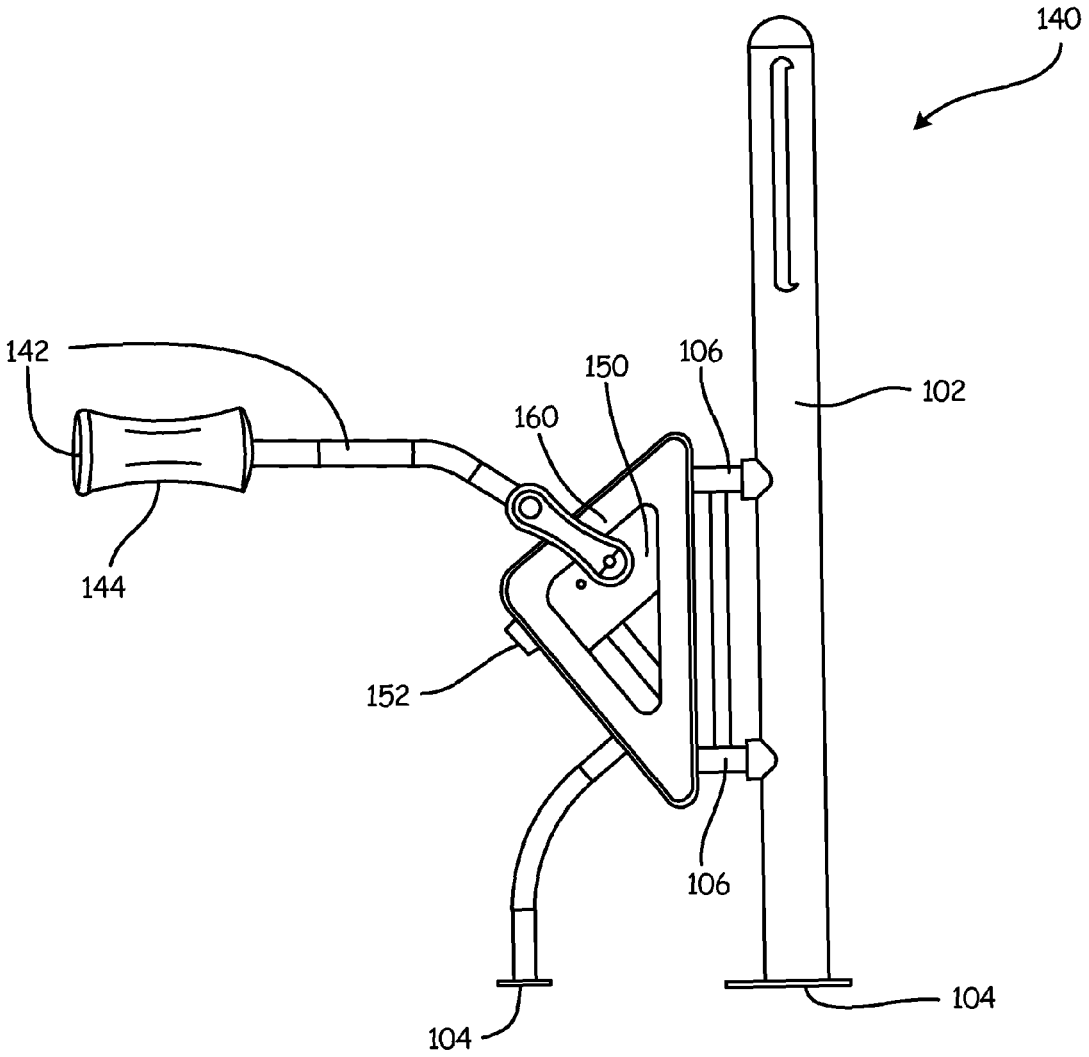

FIG. 1E illustrates a shoulder press machine 140 that includes the resistance mechanism 150 located within a housing 160. In one embodiment, such as that shown in FIG. 1E, the housing 160 is configured such that a user of the shoulder press machine 150 can see the resistance mechanism 150, for example through a plastic or glass window. However, in another embodiment, the housing 160 may be configured such that it obscures the resistance mechanism 150 from view. In one embodiment, the shoulder press machine comprises one or more shoulder press arms with pads 144.

Figure 1F:
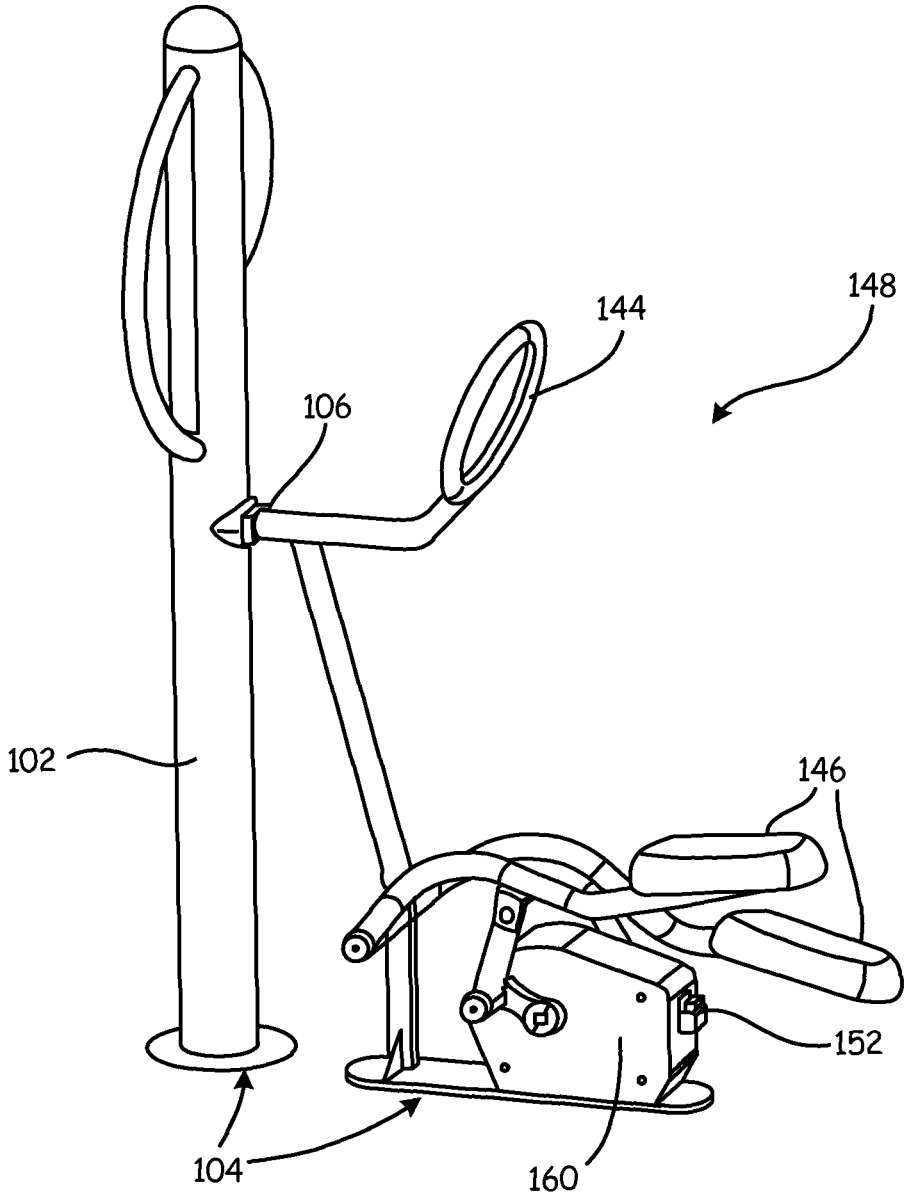

FIG. 1F illustrates a stepper machine 148 that includes the resistance mechanism 150 located within a housing 160, with a resistance mechanism 152. In one embodiment, the resistance mechanism 152 adjusts a resistance provided to a user of the stepper pedals 146. The stepper machine 148 may also include one or more stepper handles 144.

Figure 2A:
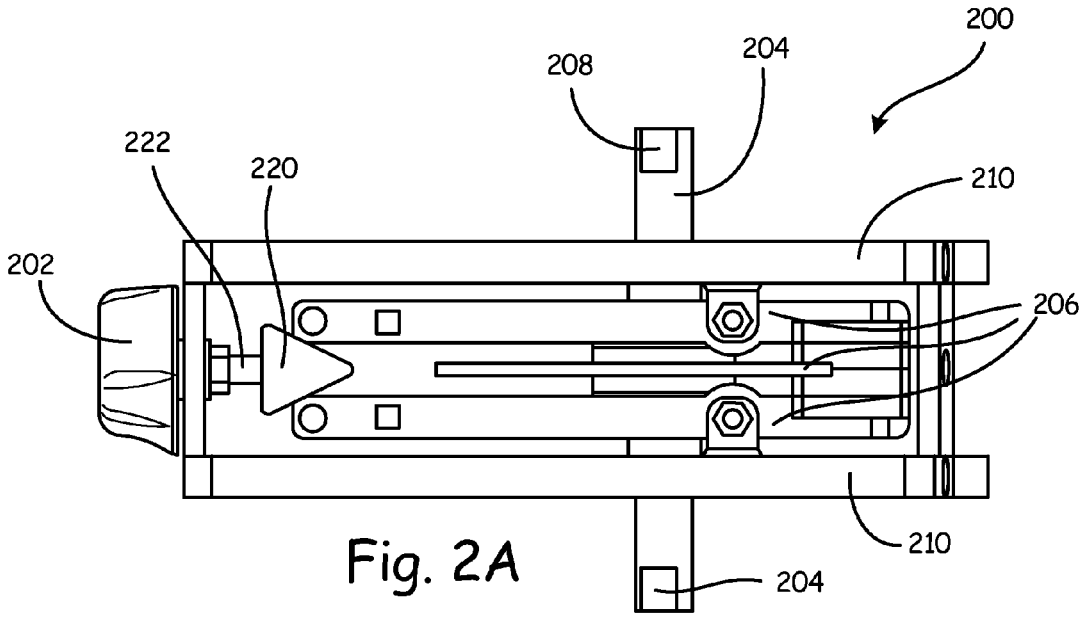
FIGS. 2A-D depict a plurality of views of a resistance mechanism that may be useful in one embodiment of the present invention.

FIGS. 2A-D depict a plurality of views of a resistance mechanism that may be useful in one embodiment of the present invention. FIG. 2A illustrates a top down view of a resistance mechanism 200. In one embodiment, the resistance mechanism 200 may be similar to the resistance mechanism 150 shown in FIGS. 1A-E. In one embodiment, the resistance mechanism 200 includes a resistance adjustment mechanism 202. In one embodiment, resistance adjustment mechanism 202 provides a continuous range of resistance levels as a user actuates the resistance adjustment mechanism 202. In another embodiment, the resistance adjustment mechanism moves through a series of preset adjustment levels. While FIG. 2A illustrates a resistance adjustment mechanism 202 that is actuated by turning, in another embodiment the resistance actuator could be a push button or buttons, that a user actuates in order increase or decrease the resistance level.

Resistance mechanism 200 may comprise one or more engagement points 204. Engagement points 204 allow the resistance mechanism to be utilized with a plurality of exercise machines, such as chest press machine 100, elliptical machine 120, or shoulder press machine 140, in one embodiment. Engagement points 204 may comprise one or more engagement mechanisms 208. The engagement mechanisms, in one embodiment, engage with one or more of the moving parts of an exercise machine (e.g. chest press arms 110, elliptical pedal levers 126 or shoulder press arms 142), such as the elliptical pedal levers 126, or a translation feature of the exercise machine, such as translation feature 114 of the chest press machine 100. Through such engagement, the variable resistance provided by the resistance mechanism 200 is provided to a user of the exercise equipment.

In one embodiment, the one or more engagement mechanisms 208 may operate in a key and lock configuration such that the engagement mechanism 208 connects with a corresponding engagement mechanism on a moving part or other translation feature in an exercise device. In one embodiment, the resistance mechanism 200 further includes a resistance translation feature 206, which translates the indicated resistance level input by a user through the resistance adjustment mechanism 202 to the engagement point 204, such that when a user actuates the resistance adjustment mechanism 202 the input resistance level is translated to the exercise device of choice. For example, if in an embodiment where the resistance mechanism 200 is input into chest press machine 100, actuation of the resistance adjustment mechanism will cause the translation feature 206 to either increase or decrease the resistance of the chest press arms 100 to a user.

In one embodiment, such as that shown in FIG. 2A, the translation feature 206 comprises at least a resistance wedge 220 connected to a resistance shaft 222. In one embodiment, when the resistance adjustment mechanism 202 is actuated, the length of the resistance shaft exposed is either increased or decreased such that the resistance wedge 220 is moved forward or backward, providing an increased or decreased amount of force on the translation feature 206. In one embodiment, the translation feature 206 may comprise at least one or more brake pads that engage with the resistance wedge 220.

Figure 2B:
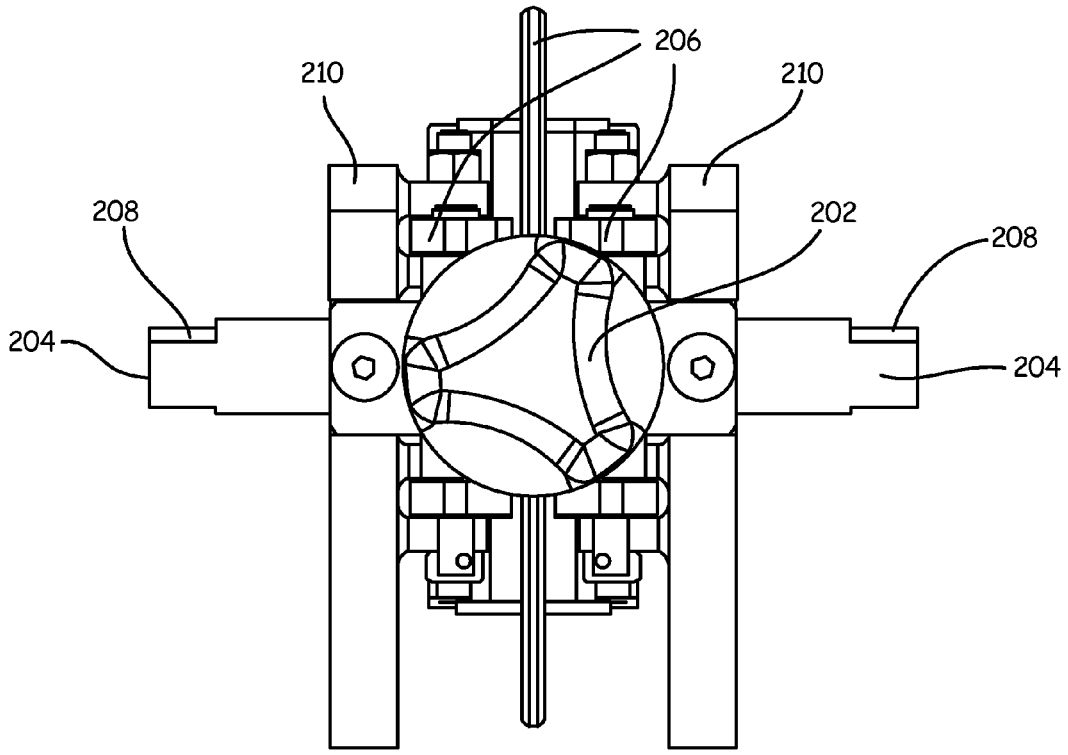

FIG. 2B illustrates a front view of a resistance mechanism 200 in one embodiment. In the embodiment shown in FIG. 2B, substantially all of the translation features 206 are comprised within a pair of resistance mechanism housing walls 210 on either side of the translation feature. However, in one embodiment, the translation feature 206 may also extend above or below the sides of resistance mechanism housing wall 210. For example, as shown in FIG. 2B a flywheel is shown to extend above a height of an upper edge of housing walls 210. However, in another embodiment the flywheel portion of translation feature 206 may extend below the lower edge of resistance mechanism housing wall 210. In a further embodiment, the housing walls 210 may be configured to be of a length that is the same as that of a flywheel feature that is part of the translation feature 206.

Figure 2C:
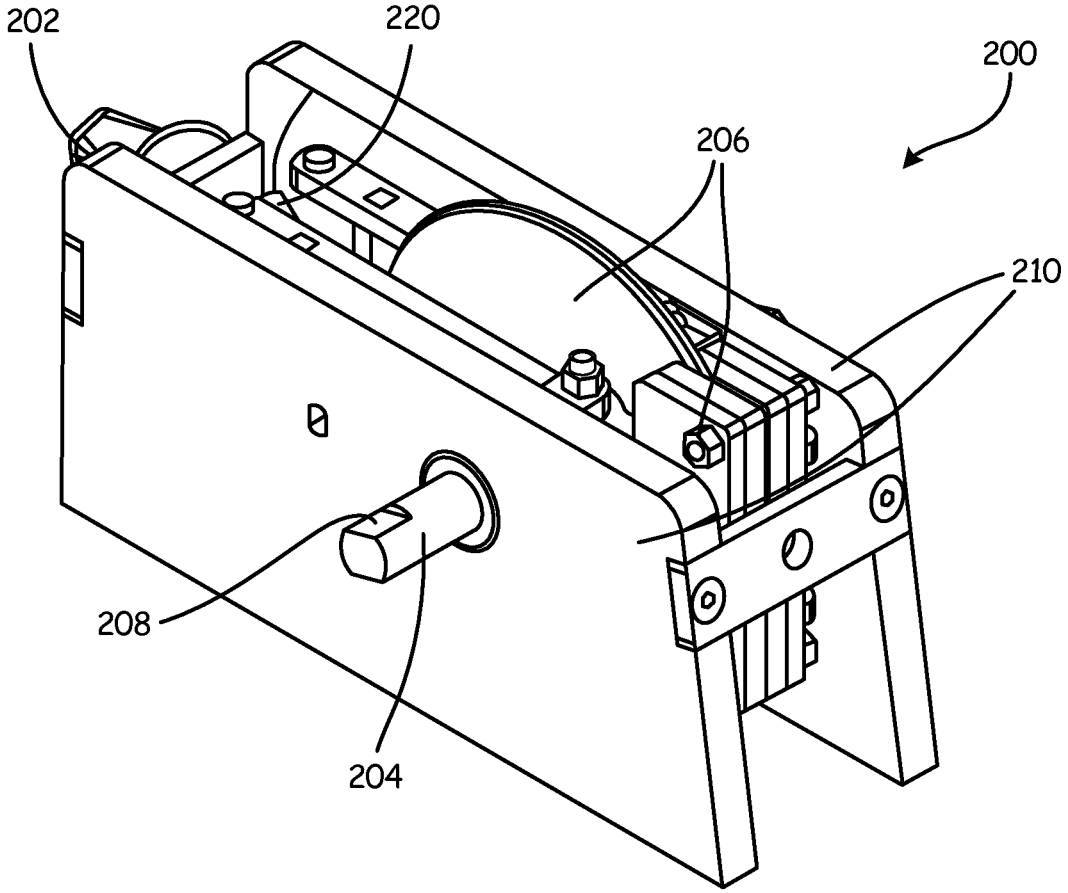
Figure 2D:
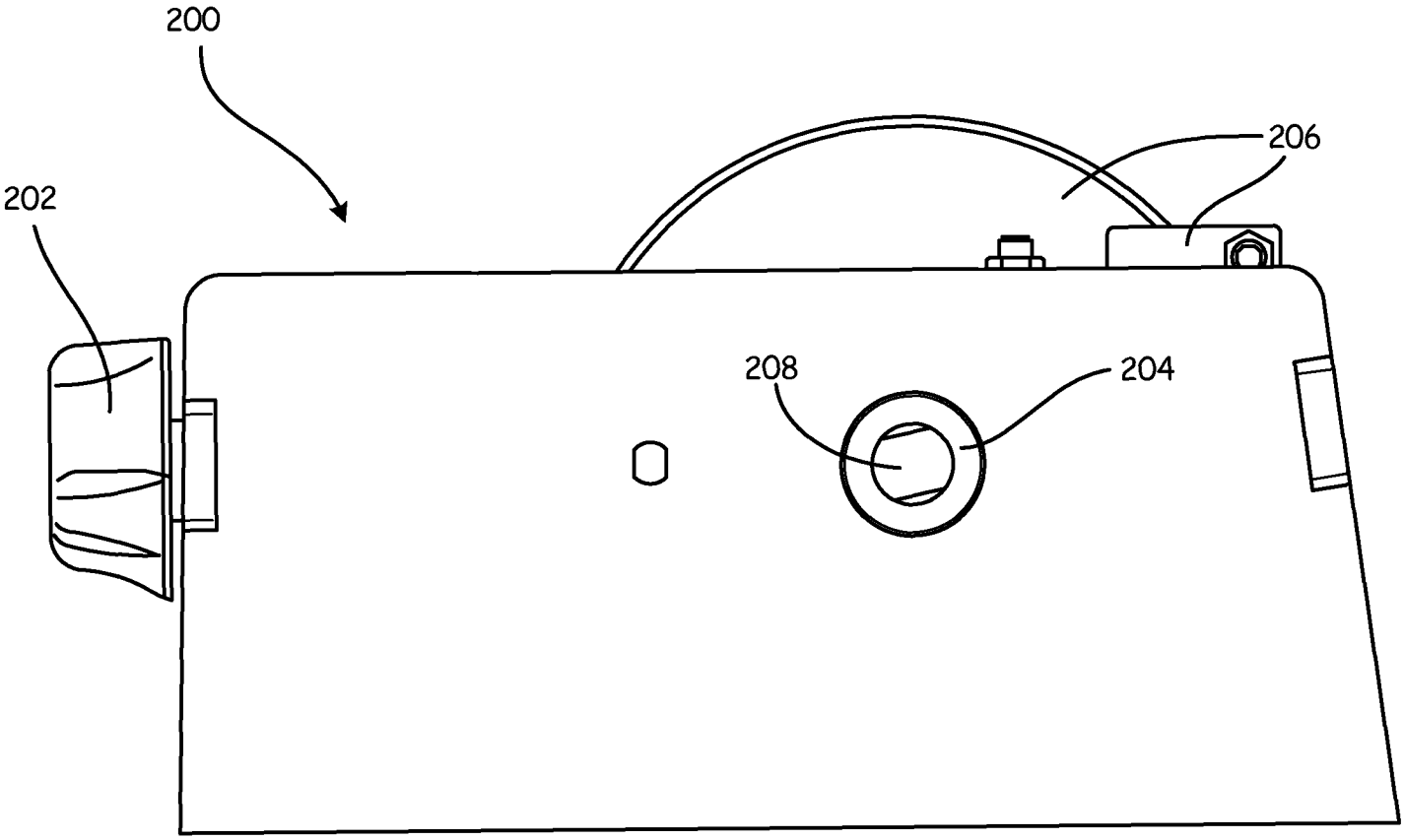

FIG. 2C illustrates a perspective view of resistance mechanism 200. FIG. 2D illustrates a substantially side view of resistance mechanism 200 in one embodiment.

In one embodiment, the resistance mechanism 200 may be held together by bolts that extend through at least a portion of the resistance mechanism housing walls 210. In another embodiment, the securing mechanism may comprise screws. In a further embodiment, the securing mechanism may comprise welding or other appropriate mechanism for securing the resistance mechanism 200. The resistance mechanism 200 may be configured such that it fits within a housing 160, for example, to provide further protection from the elements once located within an exercise device. In another embodiment, the resistance mechanism 200 may be a part of housing 160, such that it cannot be separately removed from the housing 160.

Figure 3:
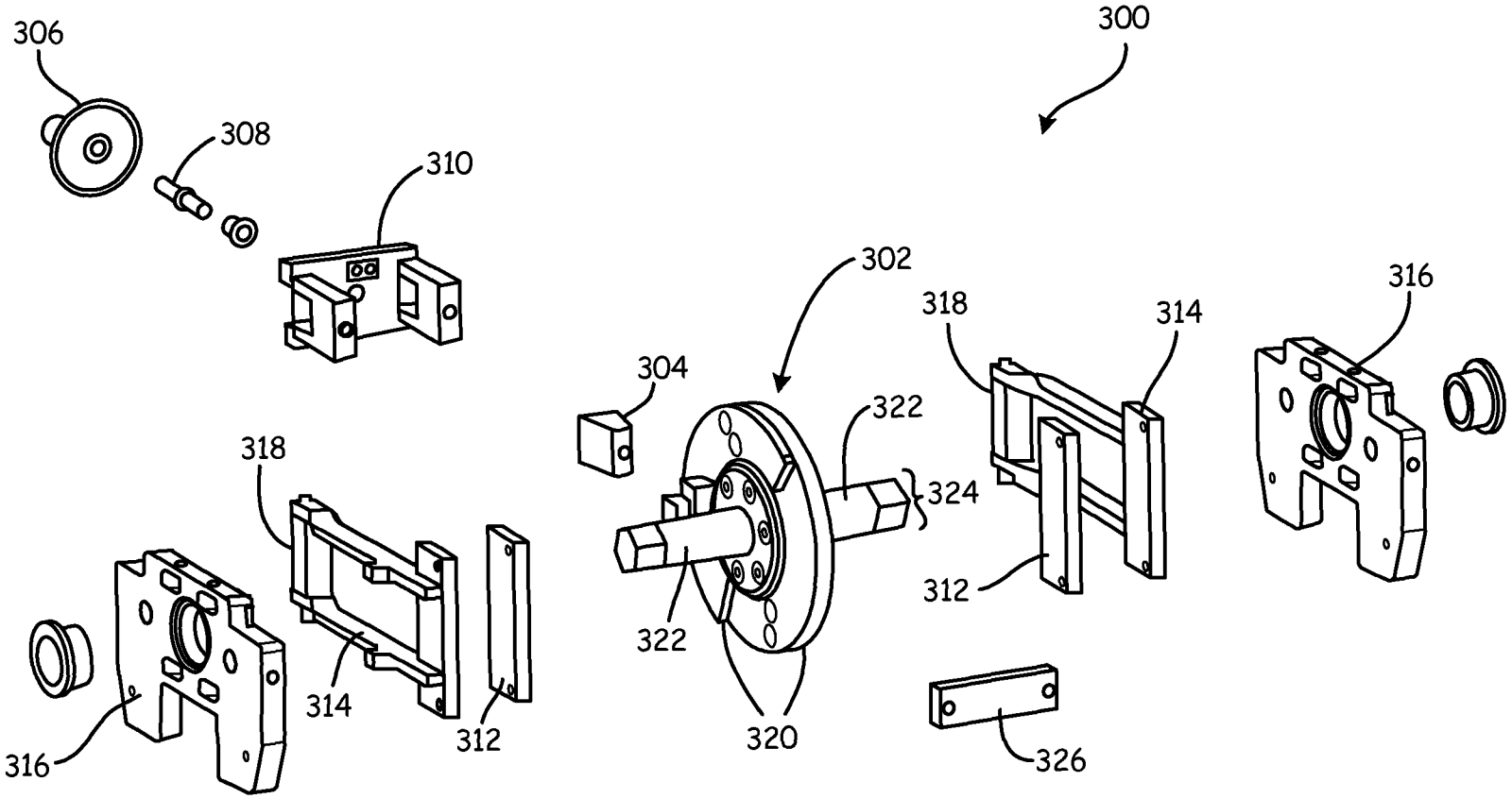
FIG. 3 presents an exploded view of a resistance mechanism that may be useful in one embodiment of the present invention.

FIG. 3 illustrates an exploded view of a resistance mechanism 300. In one embodiment, resistance mechanism 300 is substantially similar to resistance mechanism 200. In one embodiment, the resistance mechanism 300 includes at least a flywheel assembly 302. The flywheel assembly 302 comprises at least one resistance disc 320. In one embodiment, the flywheel assembly includes one resistance disc 320. In one embodiment, the flywheel assembly includes two, or more than two resistance discs 320. The resistance discs 320 may, in one embodiment, directly contact the resistance wedge 220. The resistance discs, on one embodiment, experience negligible wear when contacting the resistance wedge 220. In an embodiment where a flywheel directly contacts the resistance wedge 220, the flywheel may wear, causing the resistance mechanism 300 to wear out and produce an undesired noise while in use. Addition of the resistance discs 320, therefore, may increase the functional life of the resistance mechanism 300.

The flywheel assembly may also comprise at least one connection 322. The connection 322 may include one or more connection features 324. In one embodiment, the connection features 324 allow the resistance mechanism 300 to engage with, and provide variable resistance for, an exercise device, for example, chest press machine 100, elliptical machine 120, or shoulder press machine 140. In one embodiment, the connection features 324 comprise grooves, ridges, or other geometry configured to connect to a corresponding connection mechanism on an exercise device. In one embodiment, the flywheel assembly is connected to a housing wall, for example, resistance mechanism housing walls 210 directly. In another embodiment, the flywheel assembly is connected through a mounting plate 326. In one embodiment, the resistance mechanism 300, as shown in FIG. 3 with exemplary resistance mechanism housing walls removed for illustration.

In one embodiment, resistance mechanism 300 includes a resistance adjustment mechanism 306. In the embodiment shown in FIG. 3, the resistance adjustment mechanism 306 comprises a knob. However, in another embodiment, the resistance adjustment mechanism could comprise one or more buttons, for example one button to increase and one to decrease resistance, or any other appropriate resistance adjustment mechanism. In one embodiment, the resistance adjustment mechanism 306 is connected to a resistance adjustment mechanism shaft 308 which in turn is connected to a brake wedge 304. In one embodiment, as a user actuates the resistance adjustment mechanism 306 the resistance adjustment mechanism shaft 308 engages the brake wedge 304 such that the brake wedge 304 is pushed closer to the flywheel assembly 302, or further away from the flywheel assembly 302, thus either increasing or decreasing a resistance provided respectively. In one embodiment, the resistance adjustment mechanism and resistance adjustment mechanism shaft are located within the resistance mechanism 300 such that they are mounted on a resistance adjustment mechanism mount 310. However, in another embodiment, another mechanism for securing the resistance adjustment mechanism 300 may be used.

In one embodiment, the resistance mechanism may include one or more brake arms 314. As shown in FIG. 3, a brake arm 314 is located on either side of the flywheel assembly and comprises a wear pad 312. However, in another embodiment, only one brake arm 314 may be provided on either side of the flywheel assembly 302. In one embodiment, the resistance mechanism further includes one or more side supports 316 located on the outside of brake arms 314. In other embodiment, side supports 316 may be part of hosing walls, not shown in FIG. 3. Brake arm 314 may further include a brake roller 318, in one embodiment. The resistance mechanism 300 is configured such that when the resistance adjustment mechanism 306 is actuated the brake wedge 304 is pushed against the one or more wear pads 312. In one embodiment, the resistance adjustment mechanism 306 may include a spring pin. In one embodiment, the resistance adjustment mechanism shaft 308 may be located within an Oilite™ bushing that engages with the resistance adjustment mechanism mount 310. In one embodiment, on another side of the resistance adjustment mechanism mount 310, a thrust washer may engage the brake wedge 304. In one embodiment, the flywheel shaft assembly may further include one or more stops, or limiters. In one embodiment, the side supports 316 may further include an Oilite™ bearing, through which the connection mechanism may extend. In one embodiment, the brake arm may further include one or more cotter pins and/or one more clevis pins.

The brake wedge 304 may, in one embodiment, be an indexing wedge that allows a user of the resistance mechanism 300 to increase or decrease resistance by applying force, in one embodiment, through the resistance adjustment mechanism, on the wedge 304 such that force is applied to wear pads 312 which in turn transfer pressure against the one or more resistance discs within the flywheel assembly.

In one embodiment, the wear pads 312 are comprised of Kevlar®, available from DuPont, for example, or other para-aramid synthetic fiber. In another embodiment, the wear pads 312 may also be comprised of plastic, ceramic, or any other suitable material which would provide similar adjustable resistance. In one embodiment, the use of Kevlar® wear pads allows the resistance mechanism 300 to have a long service life when placed within an outdoor exercise equipment device. Additionally, the wear pads are designed to provide an easy and cost effective replacement once they have reached the end of their service life, without replacement required for any other portion of the resistance mechanism 300. As shown in FIG. 2A, in one embodiment, the wedge 304 does not engage directly with discs 320. However, in another embodiment, the wedge 304 may engage directly with one or more internal structures on either side of the disc or discs 320, for example, the one or more brake arms 314 with brake pads 312. However, in another embodiment, the brake wedge 304 may engage directly with the flywheel assembly, specifically resistance discs 320.

In one embodiment, support structures, for example, mounting plates 326, resistance adjustment mechanism mounts 310, and side supports 316 are provided to stabilize the resistance mechanism 300 within a housing, for example, housing 160. These support structures may be held in place through, for example, bolts, screws, or a welding process. The location of support structures, at least on the front and back of the resistance mechanism housing, further provides stabilization for the resistance mechanism 300, ensuring that the resistance mechanism 300 has a long working life within an outdoor exercise device.

In one embodiment, the resistance mechanism 300 is fully contained, such that ongoing maintenance is not required. In one embodiment, the resistance mechanism 300 is self-lubricating. In another embodiment, the resistance mechanism requires no additional lubrication once placed within a housing 160. In one embodiment, the resistance mechanism 300 is designed to be enclosed within a housing, for example, housing 160, such that it is not exposed to the elements.

An advantage of a universal resistance mechanism (such as that shown in FIGS. 1-3) is that it allows for resistance to be used in exercise devices located in an outdoor environment, for example, one where no electrical or other power source is readily available. This allows for the device to be utilized within an exercise machine located outside, for example, on a playground or in a park. In one embodiment, a plurality of exercise devices may be located in an area, for example, connected at multiple connection points to a pole 102, or other permanent structure, such as a wall or a bench. In one embodiment, for example, a plurality of elliptical machines 120 are connected to the same pole, allowing multiple users to exercise in a group utilizing exercise devices incorporating a resistance mechanism, such as resistance mechanism 300.

Although the present invention has been described with reference to preferred embodiments, workers skilled in the art will recognize that changes may be made in form and detail without departing from the spirit and scope of the invention.

What is claimed is:

1. A resistance mechanism for an exercise device comprising:

a flywheel;

a brake arm;

a resistance index wedge configured to engage with the brake arm and the flywheel; and a resistance adjustment mechanism connected to the resistance index wedge and configured to alter a resistance provided to the exercise device by pushing the resistance index wedge in a linear direction towards and against the brake arm causing the brake arm to engage with the flywheel thereby increasing pressure provided by the brake arm to the flywheel, wherein the resistance mechanism is configured to operate in an outdoor environment.

2. The resistance mechanism of claim 1, wherein engaging with the brake arm comprises engaging with a wear pad on the brake arm.

3. The resistance mechanism of claim 2, wherein the wear pad comprises a para-aramid synthetic fiber material.

4. The resistance mechanism of claim 1, wherein the resistance adjustment mechanism, when actuated, moves through a continuum of resistance level options.

5. The resistance mechanism of claim 1, wherein the resistance adjustment mechanism, when actuated, moves through a discrete number of resistance level options.

6. The resistance mechanism of claim 1, wherein the resistance adjustment mechanism comprises a knob.

7. The resistance mechanism of claim 1, further comprising a housing that at least partially encloses the resistance mechanism.

8. A resistance mechanism and housing configured to be used in an outdoor exercise device, the resistance mechanism comprising:

a flywheel mechanism configured to store and translate rotational energy;

an indexing wedge configured to apply a force to the flywheel mechanism, wherein the force applied to the flywheel mechanism is applied through the indexing wedge to the flywheel mechanism through a brake arm and translated into a level of resistance applied to a moving part of the outdoor exercise device;

a resistance adjustment mechanism configured to engage the indexing wedge by pushing the indexing wedge in a linear direction towards and against the brake arm causing the brake arm to engage with the flywheel thereby increasing the level of resistance provided by the resistance mechanism to the outdoor exercise device;

a connection mechanism configured to translate the resistance provided from the flywheel mechanism to, and allow motion of, the outdoor exercise device.

9. The resistance mechanism of claim 8, wherein the connection mechanism comprises a geometry configured to engage with a corresponding geometry of the outdoor exercise device.

10. The resistance mechanism of claim 8, wherein the indexing wedge engages at least one or more brake pads.

11. The resistance mechanism of claim 8, wherein the resistance adjustment mechanism is actuated by rotation.

12. The resistance mechanism of claim 8, wherein the level of resistance comprises one of a plurality of discrete resistance levels.

13. The resistance mechanism of claim 8, wherein the level of resistance comprises a point on a continuum of resistance.

14. An outdoor exercising machine comprising:

at least one moving part configured to provide some resistance to movement to a user of the outdoor exercising machine;

a resistance adjustment mechanism configured to, when actuated, move between a plurality of resistance settings; and a resistance mechanism configured to translate the resistance setting into a mechanical resistance to movement of the at least one moving part, wherein the resistance mechanism comprises a flywheel engaged by an indexing wedge, and wherein actuation of the resistance adjustment mechanism pushes the indexing wedge in a linear direction towards and against a brake arm causing the brake arm to engage with the flywheel thereby increasing pressure provided by the brake arm to the flywheel.

15. The outdoor exercising machine of claim 14, further comprising a machine connection feature that corresponds to a resistance connection feature, wherein the resistance connection feature connects to the flywheel and wherein the machine connection feature connects to the at least one moving part.

16. The outdoor exercising machine of claim 14, further comprising a housing for the resistance mechanism, wherein at least part of the resistance adjustment mechanism is located on an outside of the housing.

17. The outdoor exercising machine of claim 14, further comprising a brake pad located on a portion of the brake arm, and wherein the flywheel directly engages the brake pad.

18. The outdoor exercising machine of claim 17, wherein a length of the brake arm is longer than a length of the flywheel such that the indexing wedge only directly contacts the brake arm.

* * * * *